US007059880B2

(12) United States Patent
McMaster

(10) Patent No.: US 7,059,880 B2
(45) Date of Patent: Jun. 13, 2006

(54) COUPLING DEVICE FOR COAXIAL CABLE AND COMMUNICATION APPLICATIONS

(75) Inventor: Randy J. McMaster, Bloomingdale, NJ (US)

(73) Assignee: R & R Home Networking, Bloomingdale, NJ (US)

( * ) Notice: Subject to any disclaimer, the term of this patent is extended or adjusted under 35 U.S.C. 154(b) by 0 days.

(21) Appl. No.: 11/173,115

(22) Filed: Jul. 1, 2005

(65) Prior Publication Data

US 2005/0245131 A1 Nov. 3, 2005

Related U.S. Application Data

(63) Continuation-in-part of application No. 10/681,449, filed on Oct. 8, 2003, now Pat. No. 6,921,299.

(51) Int. Cl.
*H01R 29/00* (2006.01)

(52) U.S. Cl. ..... 439/188; 439/700

(58) Field of Classification Search ..... 439/188, 439/700, 824

See application file for complete search history.

(56) References Cited

U.S. PATENT DOCUMENTS

| | | | | |
|---|---|---|---|---|
| 2,515,004 | A * | 7/1950 | Haupt | 324/72.5 |
| 3,915,536 | A * | 10/1975 | Glantz | 439/188 |
| 4,658,212 | A * | 4/1987 | Ozawa et al. | 439/188 |
| 5,030,124 | A * | 7/1991 | Lorentzon | 439/188 |
| 5,877,622 | A * | 3/1999 | Aoyama et al. | 324/158.1 |
| 6,803,778 | B1 * | 10/2004 | Taniguchi et al. | 324/754 |

* cited by examiner

*Primary Examiner*—Tho D. Ta
(74) *Attorney, Agent, or Firm*—Keusey, Tutunjian & Bitetto, P.C.

(57) ABSTRACT

A coupling device having a first end for mating to a first connector of a first mating device and having a second end for mating to a second connector of a second mating device is disclosed. The coupling device includes a first conductor for extending and retracting at the first end, a second conductor at the second end and a conductive circuit for providing a conductive path from the first conductor to the second conductor. The conductive circuit is capable of being in an open circuit condition when the first conductor is in an extended position and in a closed circuit condition when the first conductor is in a retracted position. The first conductor is biased to remain in the extended position.

21 Claims, 6 Drawing Sheets

COUPLING DEVICE FOR COAXIAL CABLE AND COMMUNICATION APPLICATIONS

CROSS-REFERENCE TO RELATED APPLICATIONS

This is a continuation-in-part (CIP) application claiming the benefit of non-provisional application Ser. No. 10/681,449, entitled "Coupling Device for Coaxial Cable and Communications Applications", filed on Oct. 8, 2003, U.S. Pat. No. 6,921,299, which is incorporated by reference herein.

BACKGROUND OF THE INVENTION

1. Field of the Invention

The present invention generally relates to electronic signal coupling and, more particularly, to a coupling device. The coupling device may be used to couple, for example, coaxial cables, tap blocks, and so forth.

2. Background of the Invention

Coaxial cable is in widespread use for distributing wide band radio frequency information, such as television and radio signals. The cable television/radio industry, which relies almost exclusively on coaxial cable, is one of the most rapidly expanding segments of the United States' economy. It is anticipated that in the very near future the amount and type of information available via coaxial cable networks will be greatly expanded beyond traditional television and radio signals. By the early part of the twenty-first century, coaxial cable networks may be the principal vehicle by which consumers obtain their daily news, access library information, do their shopping, pay their bills, and otherwise interact with much of the outside world. Maintaining and controlling the integrity of the coaxial cable distribution networks that will carry such a large amount and such a wide variety of consumer information and services is a major challenge for the cable network industry.

FIG. 1 is a diagram illustrating a coaxial cable to which the present invention may be applied, according to an illustrative embodiment of the present invention. Coaxial cable typically includes a pair of conductors, a central axial conductor 12 and an outer conductor 15 that is disposed concentrically around the central conductor 12. A low-loss, high dielectric insulation material 13, such as plastic foam, is used to separate the two conductors. An outer insulating jacket 10 is often provided over the concentric conductor 15 to provide electrical insulation and physical protection to the cable. The concentric conductor 15 may be a single continuous element or, more commonly, it is a composite of several layered elements of conductive foil, wire braid or similar material.

For ease of initial installation and for flexibility with respect to subsequent modifications, coaxial cable networks comprise lengths of cable connected to one another by some sort of connection equipment. In most coaxial cable networks, such connection equipment takes the form of a male/female connection system wherein the male member is provided by a connection jack and the female member is provided by a threaded or friction-fit coupler dimensioned to attach over the jack. A standard connection jack comprises a cylindrical, externally threaded body. The outwardly projecting end of the jack is covered by a planar member that has a central aperture. Behind the aperture, within the confines of the body of the jack, is disposed an internal conductor which is shielded from the body. The body is electrically connected to one of the coaxial cable circuits and the inner conductor is connected to the other coaxial cable circuit.

The female member in the typical male/female connection system commonly comprises a jack connection moiety that is adapted to attach to the cable connection jack. The female member also comprises a cable connection moiety which physically attaches to the terminus of a coaxial cable in such a way that the cable connection moiety is in electrical contact with the concentric conductor of the coaxial cable. The cable connection moiety is adapted to allow the terminus of the central conductor to project through the center of the female member without contacting the female member, so that, when the jack moiety is attached to the outside of the conductor jack body, the central conductor terminus protrudes into the connection jack central aperture (without contacting the jack connection moiety of the female member or the conductor jack body) and is placed into electrical contact with the internal conductor of the connection jack.

Coaxial cable networks are traditionally distributed to individual residences using existing telephone company poles and underground conduits. A coaxial cable "trunk" is run through a neighborhood in parallel with telephone and electrical lines, and each residence to be serviced by the cable network is connected into ("tapped into") the trunk line. The interface between the trunk line tap and the cable line running to an individual residence (the "drop line") is traditionally called a "tap block". A tap block traditionally is a small metal box having a flat face plate called a "tap plate". Projecting outwardly from the tap plate are several coaxial cable connection jacks. Each cable service-subscribing residence in the immediate vicinity of the tap block is connected to one of the connection jacks on the tap plate.

Typically, all of the services provided by the cable network company are available at the tap face connection jacks. If a residence chooses not to pay for certain special cable network services (such as the HBO™ television network and the Pay-Per-View™ television network), a "signal trap" is interposed between the tap face connection jack and the drop line for that individual residence. A signal trap is a small electrical device having an input connector jack and an output connector jack. The signal trap is electrically configured so as to filter out or scramble the signal of a non-subscribed-to cable service.

From the tap block, a drop line is run to each individual residence and is connected to individual "receivers" (i.e., televisions or radios). Where more than one receiver is used by the residence, the drop line will terminate at a "signal splitter" having one input connection jack and two or more output connection jacks. It is common practice for many coaxial cable networks to charge an additional subscriber fee for the use of signal splitters to connect up additional receiving devices.

The problem with the use of such typical coaxial cable connection equipment is that such equipment is easy to connect, disconnect and reconnect. It is unfortunately easy for a dishonest consumer to be able to surreptitiously tap into a coaxial cable network. It is also far too easy for a dishonest consumer to reconfigure his existing coaxial cable connection system to surreptitiously connect up the cable network to additional receiving devices and to reconfigure his cable network to eliminate signal traps.

In addition to the vulnerability of typical coaxial cable connection equipment to physical tampering, typical coaxial cable network connection equipment is also vulnerable to corrosive and/or otherwise degrading conditions within the atmosphere, such as moisture, dust, and smog.

There have been many attempts to make connection equipment for coaxial cable systems more tamper resistant and more resistant to degradation from ambient-conditions. However, none of these attempts has been wholly satisfactory. Either the prior attempts relied upon connection equipment that was insufficiently resistant to tampering and/or degradation from ambient conditions or the prior attempts relied upon connection equipment which was excessively expensive to manufacture and/or awkward, complex and expensive to install in the field. Also, many prior attempts relied on connection equipment that could not be retrofit onto existing coaxial cable connection jacks.

Accordingly, there is a need for a coaxial cable coupling device that provides increased tamper resistance. There is also a need for a coaxial cable coupling device that provides increased resistance to degradation from ambient conditions. There is a still further need for a coaxial cable coupling device that, while providing adequate resistance to tampering and ambient condition degradation, is inexpensive to manufacture and is easy and inexpensive to install. Finally, there is a need for a coaxial cable coupling device that, while providing adequate resistance to tampering and ambient condition degradation, can be retrofit into existing coaxial cable network systems.

SUMMARY OF THE INVENTION

The problems stated above, as well as other related problems of the prior art, are solved by the present invention, which is directed to a coupling device. The coupling device according to the present invention may be used to interconnect coaxial cables, tap blocks, and so forth. The coupling device advantageously reduces Cumulative Leakage Index (CLI) leakage, theft, picture impairment problems (e.g., ghosting, ingress, and so forth) due to loose and/or illegal connections, and other undesirable conditions, while providing an indication of a less than optimal connection.

A coupling device having a first end for mating to a first connector of a first mating device and having a second end for mating to a second connector of a second mating device is disclosed. The coupling device includes a first conductor for extending and retracting at the first end, a second conductor at the second end and a conductive circuit for providing a conductive path from the first conductor to the second conductor. The conductive circuit is capable of being in an open circuit condition when said first conductor is in an extended position and in a closed circuit condition when said first conductor is in a retracted position. The first conductor is biased to remain in the extended position.

In other embodiments, the coupling device includes a spring for biasing the first conductor into the extended position to form the open circuit condition, and for allowing the first conductor to retract into the retracted position to form the closed circuit condition. The coupling device may include a housing and a third conductor, slidably mounted within said housing, for contacting said first conductor to form the conductive path in the closed circuit condition. The third conductor may be biased to permanently form an electrical connection with said second conductor. The third conductor may include a contact button.

The coupling device may include a threaded portion for threading onto another threaded portion of the first connector so as to push said first conductor towards said third conductor to form said closed circuit condition. The conductive circuit transition from the open circuit condition to the closed circuit condition when a pre-specified amount of torque has been applied to thread the threaded portion onto the other threaded portion. A pre-specified amount of torque may be needed to push the first conductor towards the third conductor to form the closed circuit condition and to ensure a minimum verifiable level of performance from the coupling device with respect to an electrical connection formed between the first end of the coupling device and the first connector. The second conductor may also be placed in the extended position and the retracted position, depending upon whether said first conductor is in the extended position or the retracted position, respectively.

Another coupling device having a first end for mating to a first connector of a first mating device and having a second end for mating to a second connector of a second mating device, includes a first conductor for extending and retracting at the first end, a second conductor at the second end and a switch having a closed circuit condition for connecting the first conductor in signal communication with the second conductor when the first conductor is in a retracted position, and having an open circuit condition when said first conductor is in an extended position. The first conductor is preferably biased to remain in the extended position.

In other embodiments, a spring is included for biasing the first conductor into the extended position to form the open circuit condition, and for allowing the first conductor to retract into the retracted position to form the closed circuit condition. The coupling device may include a housing, and wherein the switch comprises a third conductor, slidably mounted within said housing, for contacting the first conductor to form a conductive path in the closed circuit condition. The third conductor may be biased to permanently form an electrical connection with said second conductor. The coupling device may include a threaded portion for threading onto another threaded portion of the first connector so as to push the first conductor towards the third conductor to form the closed circuit condition.

The conductive circuit may transition from the open circuit condition to the closed circuit condition when a pre-specified amount of torque has been applied to thread the threaded portion onto the other threaded portion. A pre-specified amount of torque may be needed to push the first conductor towards the third conductor to form the closed circuit condition and to ensure a minimum verifiable level of performance from the coupling device with respect to an electrical connection formed between the first end of the coupling device and the first connector. The second conductor may also be placed in the extended position and the retracted position, depending upon whether said first conductor is in the extended position or the retracted position, respectively.

These and other aspects, features and advantages of the present invention will become apparent from the following detailed description of preferred embodiments, which is to be read in connection with the accompanying drawings.

DETAILED DESCRIPTION OF THE INVENTION

Figure 1:
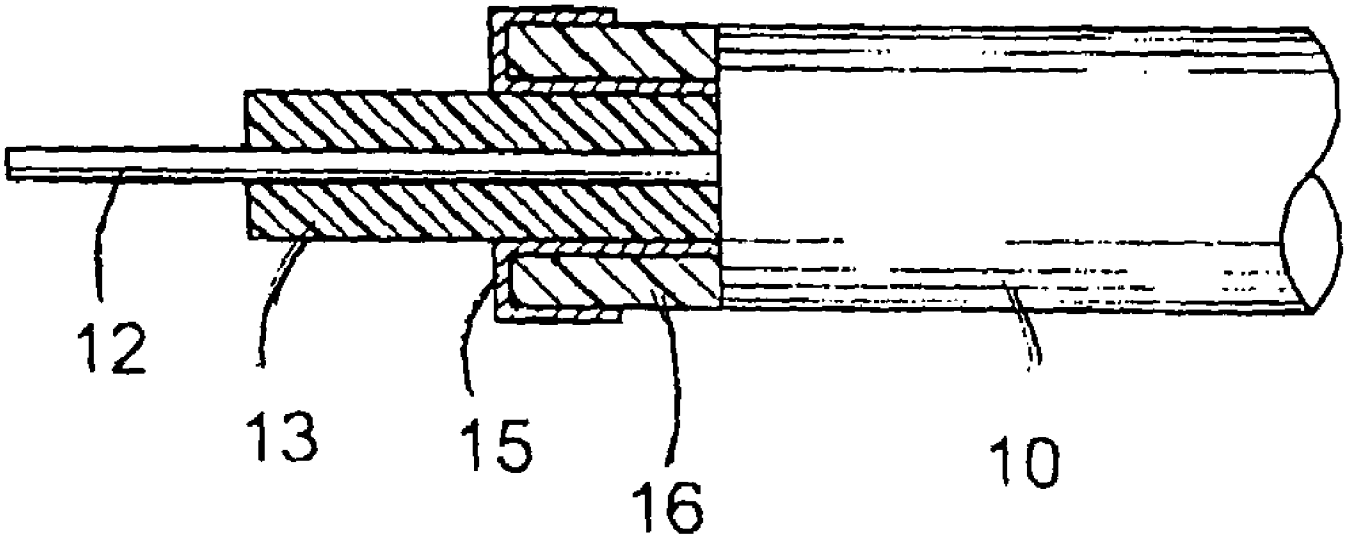
FIG. 1 is a diagram illustrating a coaxial cable to which the present invention may be applied, according to an illustrative embodiment of the present invention.

The present invention is directed to a coaxial cable coupling device. Advantageously, the coupling device according to the present invention provides an indication of whether the coupling device has been tampered with or is otherwise not operating at a pre-specified threshold performance level. Moreover, the indication may advantageously be provided without the need for a service technician or other person to physically contact the coupling device or even get too close to the coupling device.

The coupling device according to the present invention may be associated with a measurement zone that encompasses the coupling device and an area adjacent thereto. While within the measurement zone, measurements may be taken of some parameters of the coupling device. Other measurements may be taken directly from the coupling device itself. Depending on the values of the measured parameters, one or more indications may be provided that indicates tampering or other undesirable characteristics such as performance below the pre-specified threshold performance level. In this way, a service vehicle may be used to get within a measurement zone of a coupling device and to take measurements corresponding to the coupling device without the vehicle operator having to even exit the vehicle. Parameters that lend themselves to such measurements include, but are not limited to, emissions (e.g., electromagnetic and so forth). Of course, the vehicle would be proximate to the coupling device. However, in some cases, measurement instrumentation may be disposed proximate to the coupling device during installation or some other time thereafter, such that if the coupling device is not readily approached, for example when located on a pole or underground, then the operator can tap into a circuit that runs from a convenient location (e.g., ground level) to the measurement instrumentation to facilitate the rapid and safe obtaining of measurements.

The coupling device according to the present invention includes a male end and a female end. At least one end of the coupling device makes contact with a mating cable or other device only when a pre-specified amount of torque is applied, thus ensuring that the coupling device is properly connected. In this way, Cumulative Leakage Index (CLI) leakage is reduced and loose fittings are eliminated.

It is to be understood that the present invention may be implemented in various forms of hardware, software, firmware, special purpose processors, or a combination thereof. Preferably, the present invention is implemented as a combination of hardware and software. Moreover, the software is preferably implemented as an application program tangibly embodied on a program storage device. The application program may be uploaded to, and executed by, a machine comprising any suitable architecture. Preferably, the machine is implemented on a computer platform having hardware such as one or more central processing units (CPU), a random access memory (RAM), and input/output (I/O) interface(s). The computer platform also includes an operating system and microinstruction code. The various processes and functions described herein may either be part of the microinstruction code or part of the application program (or a combination thereof) that is executed via the operating system. In addition, various other peripheral devices may be connected to the computer platform such as an additional data storage device and a printing device.

It is to be further understood that, because some of the constituent system components and method steps depicted in the accompanying Figures are preferably implemented in software, the actual connections between the system components (or the process steps) may differ depending upon the manner in which the present invention is programmed. Given the teachings herein, one of ordinary skill in the related art will be able to contemplate these and similar implementations or configurations of the present invention.

Figure 2:
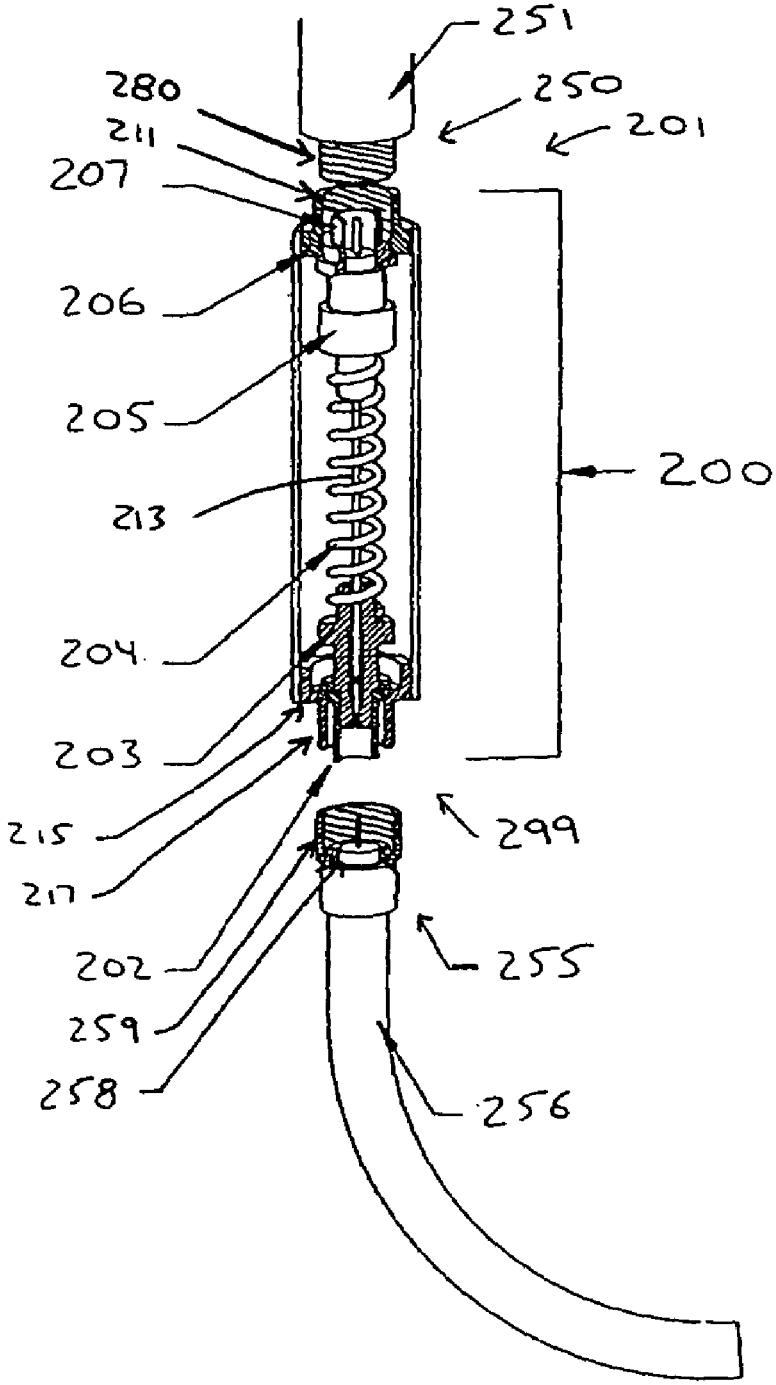
FIG. 2 is a diagram illustrating a coupling device 200, according to an illustrative embodiment of the present invention.

FIG. 2 is a diagram illustrating a coupling device 200, according to an illustrative embodiment of the present invention. The coupling device 200 includes a male end 201 and a female end 299. The male end 201 of the coupling device 200 is shown being coupled to a female "F" connector 250 of a first coaxial cable 251. The female end 299 of the coupling device 200 is shown being coupled to a male "F" connector 255 of a second coaxial cable 256. The first coaxial cable 251 and the second coaxial cable 256 may be, for example, RG-6 or RG-59 type coaxial cable or any other type of coaxial cable.

The coupling device 200 includes a pin 213 and pin holder 205, a threaded portion 206, a spring 204, a spring sleeve 207, a spring receptor 203, a spring cylinder 202, and a threaded portion 215.

At the male end 201 of the coupling device 200, the pin 213 and pin holder 205 are disposed inside of the threaded portion 206, and the spring sleeve 207 protrudes into an internal area of the threaded portion 206. The threaded portion 206, in particular the internal area thereof, includes an internal thread 211.

To couple the male end 201 of the coupling device 200 to the female "F" connector 250 of the first coaxial cable 251, the external thread 280 of the female "F" connector 250 is threaded into the internal thread 211 of the threaded portion 206 at the male end 201 of the coupling device 200. The threading of the external thread 280 of the female "F" connector 250 into the internal thread 211 of the threaded portion 206 at the male end 201 of the coupling device 200 pushes the pin 213 at the male end 201 of the coupling device 200 towards and into a corresponding pin receiving portion (not shown) of the female "F" connector 250 so as to form an electrical connection there between.

At the female end 299 of the coupling device 200, the pin receptor 203 is retracted inside of the spring cylinder 202, and the spring cylinder 202 protrudes into an internal area of a threaded portion 215 such that a portion of spring cylinder 202 extends past the threaded portion 215. The threaded portion 215, in particular an external area thereof, includes an external thread 217. The spring cylinder 202 is structurally biased to remain closed so as to keep the pin receptor 203 retracted inside of the spring cylinder 202, in the absence of force of a particular magnitude and opposite in direction to that applied by the spring 204.

Figure 4:
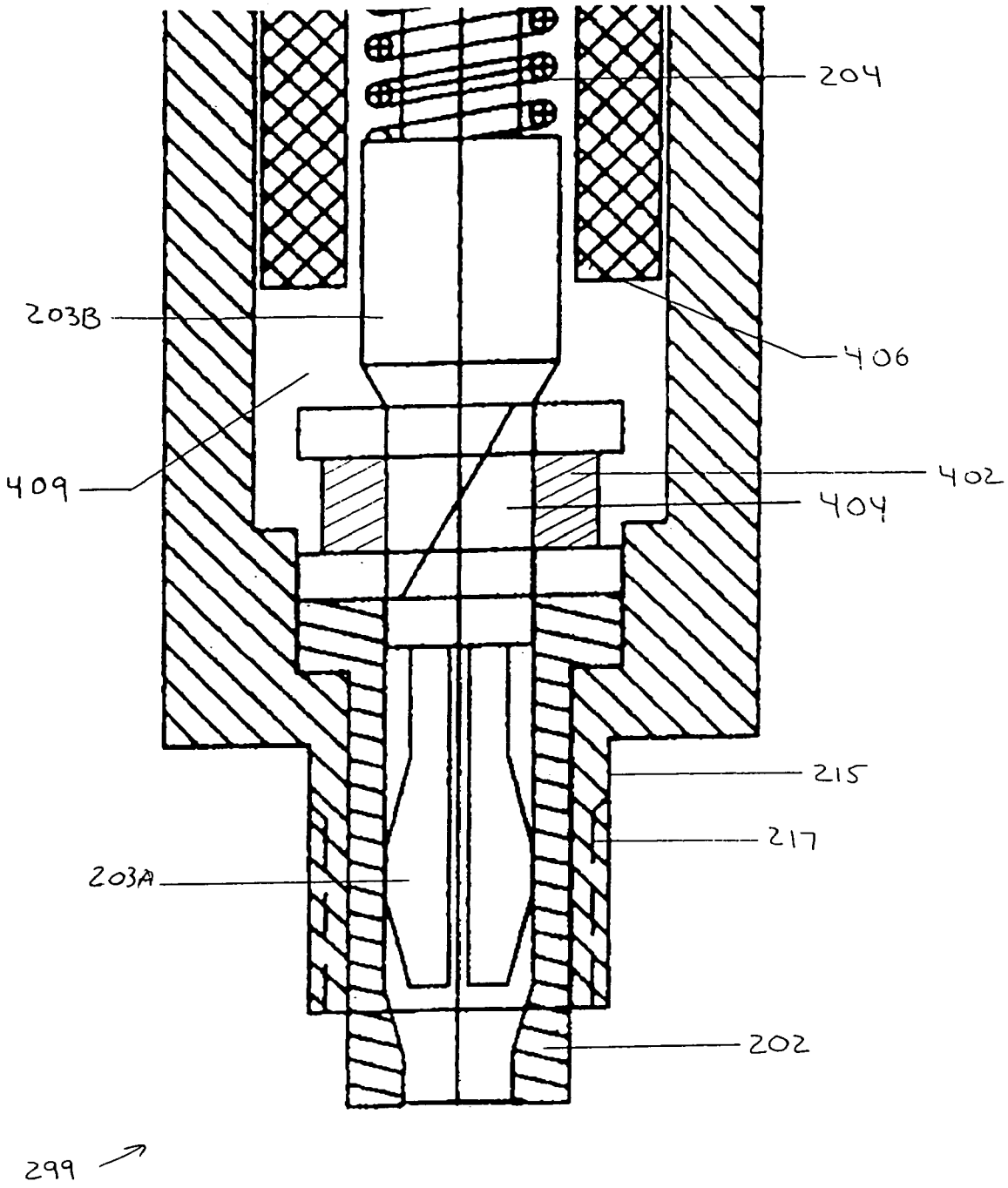
FIG. 4 is a diagram further illustrating the female end 299 of the coupling device 200 of FIG. 2, according to an illustrative embodiment of the present invention.

FIG. 4 is a diagram further illustrating the female end 299 of the coupling device 200 of FIG. 2, according to an illustrative embodiment of the present invention. The spring cylinder 202 of the female end 299 can be considered to include or to cooperate with a spring clip 402, a spring clip insulator 404, and an insulator tube 406. The spring clip insulator 404 includes a diagonal cut that allows the spring clip insulator 404 to separate under pressure (when the pre-specified torque is applied) into an open position and to return a closed position when the pressure is removed and a reset action is applied (via, e.g., a reset tool or even manually by a user pushing the pin receptor 203 back towards the spring 204 so as to push the second end 203B of the pin receptor 203 past the spring clip insulator 404). The spring clip 402 surrounds at least a portion of the circumference of the spring clip insulator 404 so as to contribute to retaining the spring clip insulator 404 in the closed position in the absence of pressure, and includes a horizontal cut that is substantially perpendicular to the direction of movement of the pin receptor 203. The pin receptor 203 includes a first end 203A and a second end 203B. The first end 203A mates with a pin 499 of the male "F" connector 255 of the second coaxial cable 256.

As an external thread 259 of the male "F" connector 255 of the second coaxial cable 256 is threaded onto the external thread 217 of the threaded portion 215 of the female end 299 (see also FIG. 2), an internal portion 258 of the male "F" connector 255 pushes the spring cylinder 202 towards the insulator tube 406, so as to compress the spring clip 402 and the spring clip insulator 404 and force the spring clip 402 and the spring clip insulator 404 into the open position. It is to be appreciated that when the spring clip 402 and the spring clip insulator 404 are compressed, they expand in channel 409. When the spring clip 402 and the spring clip insulator 404 are in the open position, the second end 203B of the pin receptor 203, under pressure by spring 204, is able to pass there through and extend towards the pin 499. Upon the application of the pre-specified amount of torque, an electrical connection is formed between the pin receptor 203 at the female end 299 of the coupling device 200 and the pin 499 of the male "F" connector 255 of the second coaxial cable 256.

It is to be appreciated that while only the female end 299 of the coupling device 200 is described herein with respect to having a retractable and extendable portion, the male end 201 of the coupling device 200 may also be similarly configured to provide the benefits inherent in the coupling approach provided at the female end 299. For example, the pin receptor 203 may simply be replaced with a pin at the male end 201 of the coupling device to obtain a similar arrangement to that described herein with respect to the female end 299 of the coupling device 200.

The pin 213 that extends at the male end 201 of the coupling device 200 through pin holder 205 and that extends at the female end 299 as part of the pin receptor 203 provides conductivity to, for example, central axial conductor of a coaxial cable connected to the coupling device 200 such as central axial conductor 12 shown in FIG. 1. At the female end, the pin 213 may open up and be flared out to receive, encompass, and form an electrical connection with a pin such as that included in the male "F" connector 255. The spring 204 provides conductivity to, for example, an outer conductor of a coaxial cable connected to the coupling device such as outer conductor 15 shown in FIG. 1. Of course, as noted above, other devices other than coaxial cables may be connected to the coupling device 200 including, but not limited to tap blocks and so forth.

The elements of the coupling device 200 and the use of a pre-specified torque amount to connect one or more of the ends of the coupling device 200 to coaxial cables enables an indication to be provided when the coupling device 200 has been tampered with, has degraded to due natural causes (e.g., environmental), or is otherwise not performing at a pre-specified threshold performance level. Under-tightening the ends of the coupling device 200 when coupling the coupling device 200 to coaxial cables prevents the formation of electrical connections there between, as the pre-specified amount of torque ensures that the spring cylinder 202 at the female end 299 opens and releases the pin receptor 203 to form the desired electrical connection. Over-tightening the ends of the coupling device 200 results in CLI leakage and other undesirable operation conditions. Thus, tampering may be evidenced by the fact that the customer is no longer receiving a signal because the coupling device 200 has not been re-connected (after tampering) using a sufficient amount of torque to form an electrical connection at each end, or may be evidenced by the CLI leakage or other detrimental performance. Moreover, tampering may be evidenced by the presence of CLI leakage or other detrimental conditions, or by a decrease in performance (e.g., signal quality, and so forth).

It is to be appreciated that the use of the pre-specified torque amount eliminates the problem of loose fittings by ensuring that, at the least, a minimum amount of torque has been applied to form a connection with sufficient integrity. It is to be further appreciated that the elements of the coupling device 200 provide increase resistance to degradation from ambient conditions by forming tight, weather-resistant couplings at each end. Moreover, it is to be appreciated that the coupling device according to the present invention may be readily retrofitted in many coupling applications.

Advantageously, the coupling device according to the present invention is associated with a measurement zone that encompasses the coupling device and an area adjacent thereto. While within the measurement zone, measurements may be taken of parameters of the coupling device. Such parameters may include, but are not limited to, Cumulative Leakage Index (CLI), voltage, current, resistance, impedance, magnetic flux, and so forth. Depending on the values of the measured parameters (e.g., the CLI parameter to be detected may be, e.g., 20 UV/M), one or more indications may be provided that indicate tampering or other undesirable characteristics such as performance below the pre-specified threshold performance level. Of course, not all of these parameters may be measured remotely from the coupling device. Given the teachings of the present invention provided herein coupled with the knowledge known to those of skilled in the relevant art, these and other parameters, as well as the conditions for measuring those parameters, may be readily ascertained and implemented in accordance with the present invention while maintaining the spirit thereof.

As is known, these parameters may be measured from a distance to the coupling device such as from a vehicle located adjacent to, above, or below the coupling device. In this way, a service vehicle may be used to get within a measurement zone of a coupling device and to take measurements corresponding to the coupling device without the vehicle operator having to even exit the vehicle.

Figure 3:
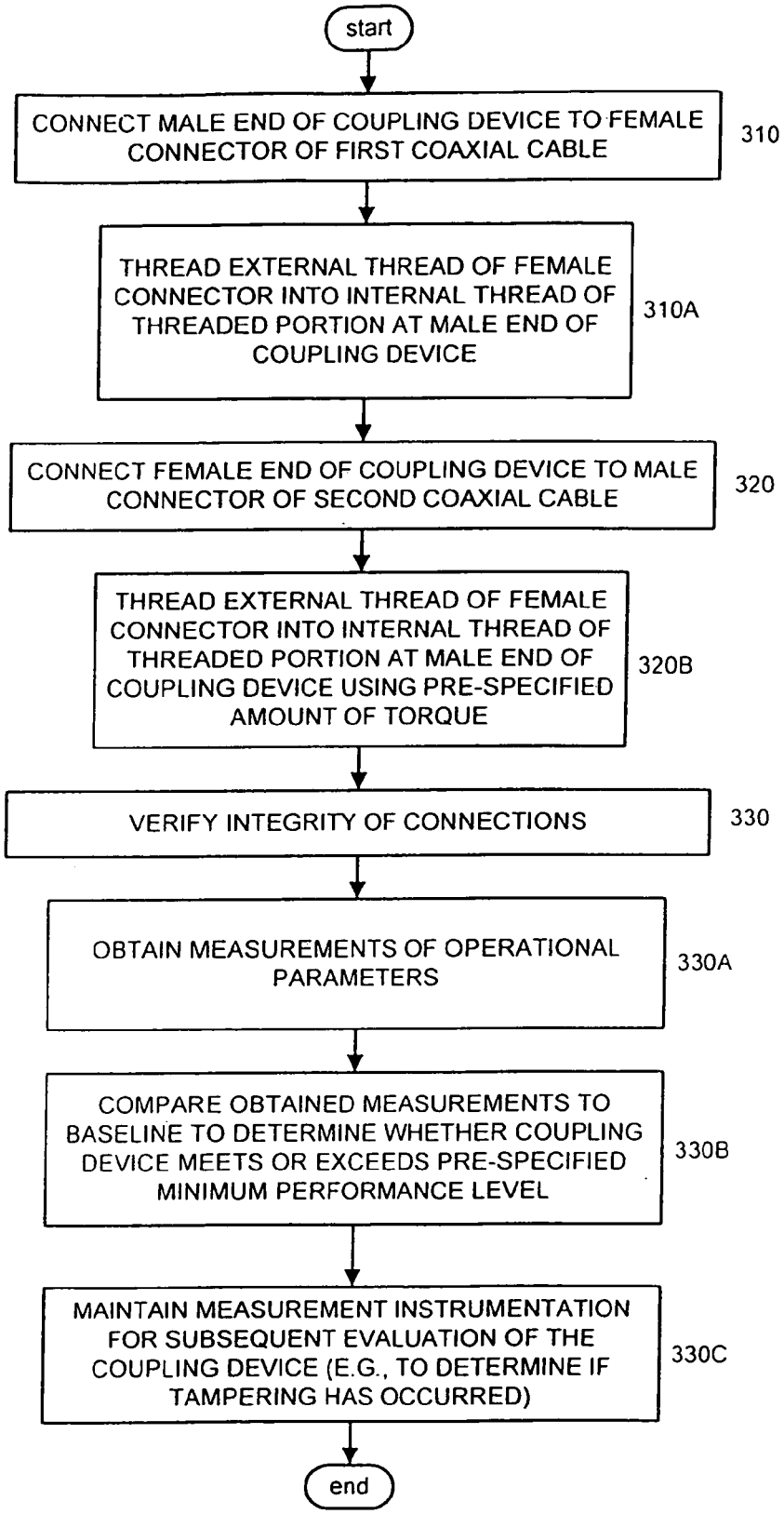
FIG. 3 is a flow diagram illustrating a method for connecting the coupling device 200 of FIG. 2 and for verifying a pre-specified minimum performance level thereof, according to an illustrative embodiment of the present invention.

FIG. 3 is a flow diagram illustrating a method for connecting the coupling device 200 of FIG. 2 and for verifying a pre-specified minimum performance level thereof, according to an illustrative embodiment of the present invention. As noted above, the coupling device 200 includes a male end 201 and a female end 299. It is to be appreciated that while the method of FIG. 3 begins with connecting the male end 201, either of the male end 201 or the female end 299 may be connected first. Moreover, it is to be further appreciated that while the method of FIG. 3 is described with respect to connecting a first coaxial cable 251 and a second coaxial cable 256, other devices that pertain to the field of signal transmission via coaxial cables may also be connected to the coupling device 200. For example, a tap block may also be connected to coupling device 200. Given the teachings of the present invention provided herein, one of ordinary skill in the related art will contemplate these and various other devices to which coupling device 200 may be connected.

The male end 201 of the coupling device 200 is connected to the female "F" connector 250 of a first coaxial cable 251 (step 310). Step 310 includes threading the external thread 280 of the female "F" connector 250 into the internal thread 211 of the threaded portion 206 at the male end 201 of the coupling device 200 (step 310A).

The female end 299 of the coupling device 200 is connected to the male "F" connector 255 of a second coaxial cable 256 (step 320). Step 320 includes threading the internal thread 259 of the male "F" connector 255 onto the external thread 217 of the threaded portion 215 at the female end 299 of the coupling device 200 using a pre-specified amount of torque (step 320A).

Upon connecting the male end 201 and the female end 299, the integrity of the connections is verified (step 330). Step 330 may include obtaining measurements of operational parameters of the coupling device 200 including, but not limited to, Cumulative Leakage Index (CLI), voltage, current, resistance, impedance, magnetic flux, and so forth (step 330A). The operational parameters may be used to verify a pre-specified minimum level of performance of the coupling device 200. Accordingly, step 330 may further include comparing the obtained measurements to baseline measurements to determine whether the coupling device at least meets the baseline measurements, which would indicate proper performance (i.e., performance equal to or greater than the pre-specified minimum level of performance) (step 330B). Step 330 may also include setting-up/maintaining measurement instrumentation and corresponding circuitry (e.g., wiring, etc.) for subsequent evaluation of the coupling device 200 (step 330C). Step 330C may be performed, for example, when the coupling device 200 is located in a location not readily accessible or convenient (e.g., on a pole or underground), such that the operator can tap into the circuit from a more accessible or convenient location (e.g., ground level). Step 330C is performed so that subsequent measurements may be taken, for example, to ensure that the minimum pre-specified performance level is being maintained and to detect tampering with the coupling device 200.

The integrity of the connections may be verified at the time of connection or at a subsequent time. In a preferred embodiment of the present invention, the integrity of the connections are verified immediately subsequent to connection to establish a baseline set of measurements which may be later used for comparison purposes to identify any degradation in performance of either of the two connections. Alternatively, general performance characteristics previously obtained by measuring a plurality of coupling devices may be used as a baseline, with subsequent measurements of the actual coupling device being tested compared to the baseline.

Figure 5:
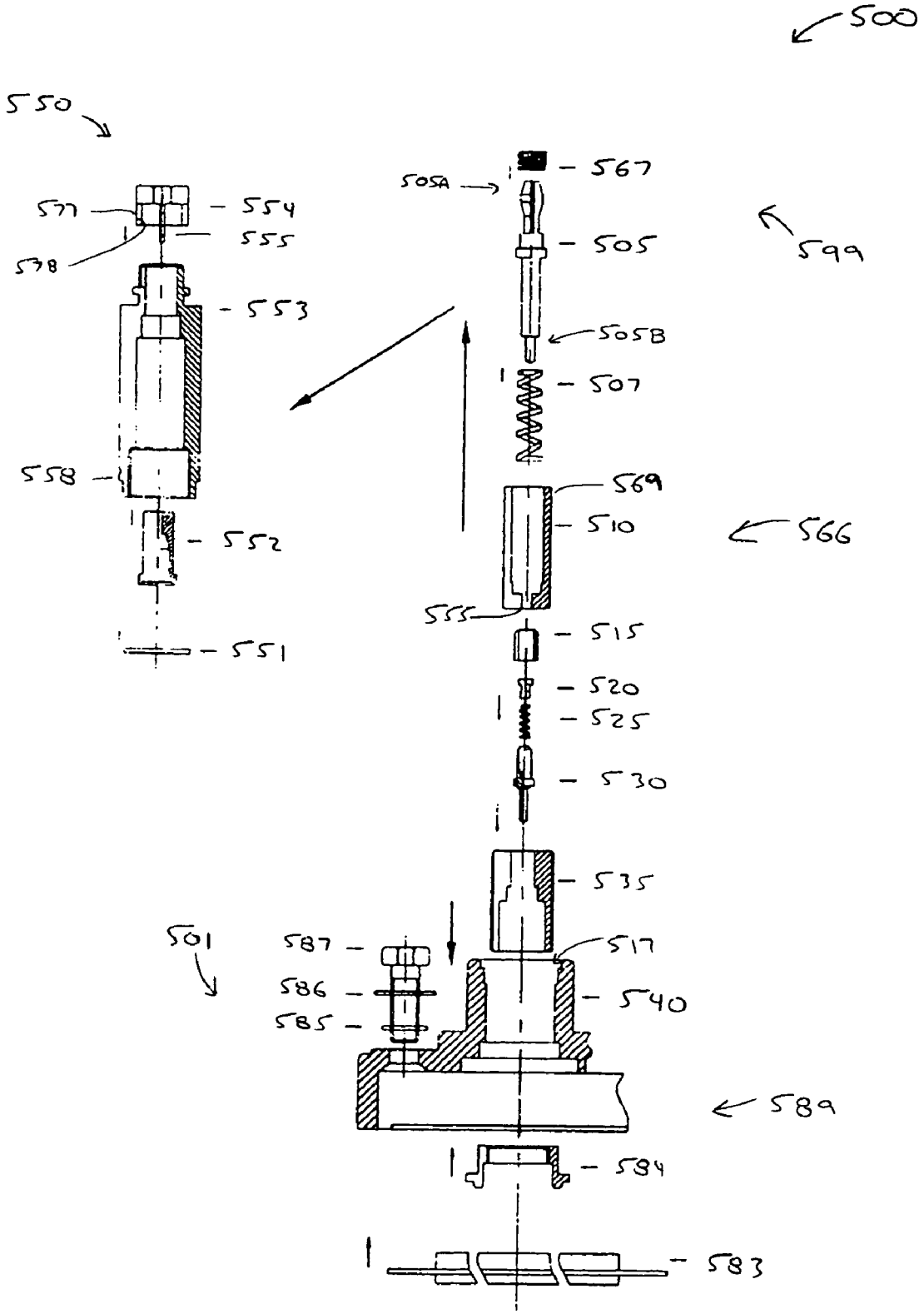
FIG. 5 is a diagram illustrating a coupling device 500, according to another illustrative embodiment of the present invention.

FIG. 5 is a diagram illustrating a coupling device 500, according to another illustrative embodiment of the present invention.

The coupling device 500 includes a male end 501 and a female end 599.

The male end 501 of the coupling device 500 is coupled to a retaining plate 589, which may be attached to a wall using a bolt 587, a washer 586, and an o-ring 585. An end cap 584 may also be used to couple the coupling device 500 to the retaining plate 589. A gasket 583 may be used to seal out moisture, dust, and so forth from the retaining plate 589.

The female end 599 of the coupling device 500 is coupled to a cable television connector 550. The cable television connector 550 includes an o-ring 551, a rod nozzle 552, and a cable television plug 553. The cable television connector 550 mates with a cable wire 554. The cable wire 554 includes a connector 577 with an internal thread 578 and terminated with a pin 555. A spring 567 provides a spring force between the coupling device 500 and the cable television connector 550, e.g., to prevent uncoupling due to vibration.

The coupling device 500 includes a pin receptor 505, a spring 507, a spring holder 510, a pin holder 515, a contact button 520, a spring 525, a connecting pin 530, a screw connector 535, and a retaining plate mounting base 540. The pin receptor 505 includes a first end portion 505A and a second end portion 505B.

In the illustrative embodiment of FIG. 5, the pin receptor 505, the contact button 520, the connecting pin 530, and the screw connector 535 are fabricated from copper, the spring holder 510, the pin holder 515, and the retaining plate mounting base 540 are fabricated from nylon, and the springs 507 and 525 are fabricated from stainless steel. However, it is to be appreciated that the present invention is not limited to solely these materials and, thus, other materials may also be employed for the elements shown in FIG. 5 while maintaining the scope of the present invention. For example, conductive materials other than copper may be used for the pin receptor 505, the contact button 520, the connecting pin 530, and the screw connector 535, and non-conductive materials other than nylon may be used for the spring holder 410, the pin holder 515, and the retaining plate mounting base 540.

When the coupling device is unconnected, the spring 507 biases a conductive path 566 formed from the conductive elements of the coupling device 500 to be in an open circuit condition. In particular, the spring 507 biases the second end portion 505B of the pin receptor 505 to be in a non-contact position with the contact button 520, thereby being in the open circuit condition.

The cable television connector 550 is coupled to the coupling device 500 by threading external thread 558 of the cable television connector 550 into an internal thread 517 of the retaining plate mounting base 540.

Once the cable television connector 550 is coupled to the coupling device 500, as an internal thread of the cable wire 554 is threaded into an external thread 558 of the cable television connector 550, the pin 555 mates with (is inserted into) the pin receptor 505 and pushes the pin receptor 505 in a direction away from the cable wire 554. As the pin receptor 505 is pushed away, the spring force of spring 507 is sufficiently overcome to allow the second end portion 505B of the pin receptor 505 to pass through an opening in the spring holder 510 and to mate with (contact) the contact button 520 to provide a closed circuit condition.

In further detail, upon the application of the pre-specified amount of torque or the achievement of a pre-specified amount of displacement of the pin receptor 505, an electrical connection is formed between the pin receptor 505 at the female end 599 of the coupling device 500 and the pin 555 of the cable television connector 550. This electrical connection extends to the male end 501 of the coupling device 500. That is, when the pre-specified amount of torque or displacement is obtained, the spring force of spring 507 is overcome, allowing the second end portion 505B of the pin receptor to pass through an opening 555 in the spring holder 510 to contact the contact button 520. The contact button 520 provides electrical continuity to the male end 501 of the coupling device 599 via the connecting pin 530.

Thus, the contact button 520 may be considered to function as a switch or as part of a conductive path that has an open circuit condition and a closed circuit condition.

It is to be appreciated that while the coupling device 500 is described with respect to connecting with a cable television connector 550, in other embodiments of the present invention, the cable wire 554 may directly couple to the coupling device 500, obviating the need or use for the cable television connector 550. In such a case, the internal thread 578 of the connector 577 of the cable wire 554 is threaded into an external thread 569 of the spring holder 510 to overcome the spring force of spring 507 as described above to achieve the closed circuit condition. Moreover, in some embodiments of the present invention, the cable television connector 550 may be considered to be part of the coupling device.

It is to be further appreciated that in some embodiments of the present invention, depending on the specific elements used (e.g., depending on the lengths of pin receptor 505, contact button 520, and connecting pin 530), the position of the connecting pin 530 may vary with the position of the pin receptor 505. That is, the connecting pin 530 may be placed in an extended position and a retracted position, depending upon whether the pin receptor 505 is in an extended position or a retracted position, respectively.

It is to be even further appreciated that while a "pre-specified torque amount" is used herein to describe the coupling of the coupling device according to the present invention to other devices (e.g., coaxial cables, tap blocks, and so forth), the present invention may be employed such that a pre-specified torque range is used in place of a single discrete torque value. This allows some flexibility due to, for example, slight deviations caused by a less than perfect calibration of the equipment applying the torque, and so forth. Moreover, in place of torque, others properties such as displacement and so forth may be used to verify the integrity of the connections.

Figure 6:
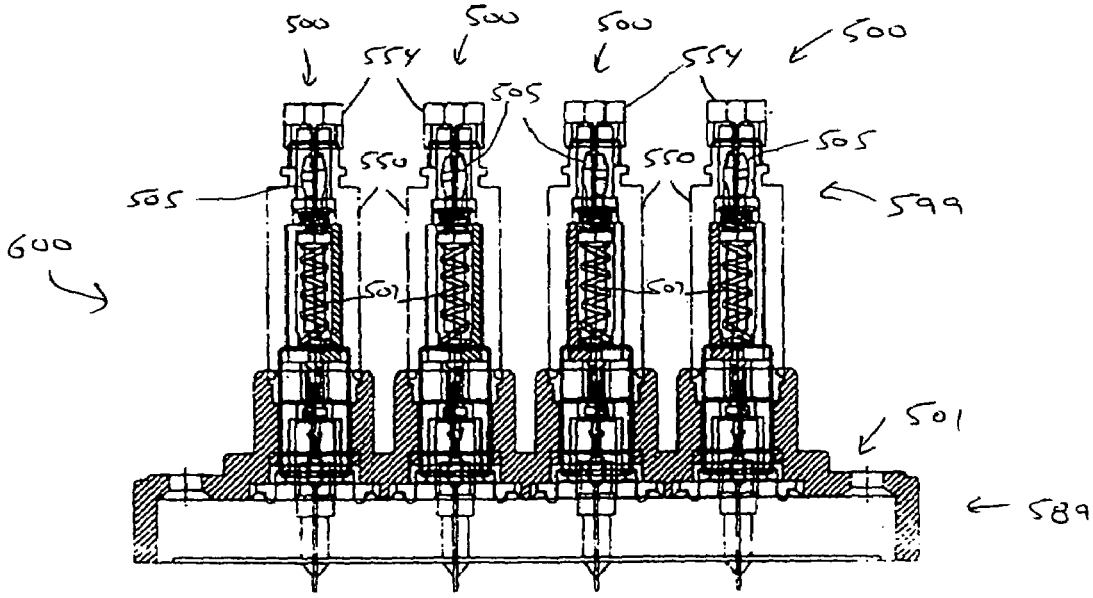
FIG. 6 is a diagram a plurality of coupling devices 600 connected to a retaining plate 589, according to an illustrative embodiment of the present invention.

FIG. 6 is a diagram a plurality of coupling devices 600 connected to a retaining plate 589, according to an illustrative embodiment of the present invention. The plurality of coupling devices 600 is formed from a plurality of the coupling device 500 shown and described with respect to FIG. 5. The retaining plate 589 is similar to that shown and described with respect to FIG. 5.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A coupling device having a first end for mating to a first connector of a first mating device and having a second end for mating to a second connector of a second mating device, the coupling device comprising:

a first conductor for extending and retracting at the first end;

a second conductor at the second end; and a conductive circuit for providing a conductive path from the first conductor to the second conductor, the conductive circuit capable of being in an open circuit condition when said first conductor is in an extended position and in a closed circuit condition when said first conductor is in a retracted position, wherein said first conductor is biased to remain in the extended position.

2. The coupling device of claim 1, further comprising a spring for biasing said first conductor into the extended position to form the open circuit condition, and for allowing said first conductor to retract into the retracted position to form the closed circuit condition.

3. The coupling device according to claim 1, wherein said second conductor is also placed in the extended position and the retracted position, depending upon whether said first conductor is in the extended position or the retracted position, respectively.

4. The coupling device according to claim 1, wherein the first and the second mating devices are both non-illuminating devices.

5. The coupling device according to claim 1, wherein the first and the second mating devices are configured to carry media signals.

6. The coupling device according to claim 1, further comprising:

a housing; and a third conductor, slidably mounted within said housing, for contacting said first conductor to form the conductive path in the closed circuit condition.

7. The coupling device according to claim 6, wherein said third conductor is biased to permanently form an electrical connection with said second conductor.

8. The coupling device according to claim 6, wherein said third conductor comprises a contact button.

9. The coupling device according to claim 6, further comprising a threaded portion for threading onto another threaded portion of the first connector so as to push said first conductor towards said third conductor to form said closed circuit condition.

10. The coupling device according to claim 9, wherein the conductive circuit transitions from the open circuit condition to the closed circuit condition only when a pre-specified amount of torque has been applied to thread the threaded portion onto the other threaded portion.

11. The coupling device according to claim 9, wherein a pre-specified amount of torque is required to push said first conductor towards said third conductor to form said closed circuit condition and to ensure a minimum verifiable level of performance from the coupling device with respect to an electrical connection formed between the first end of the coupling device and the first connector.

12. A coupling device having a first end for mating to a first connector of a first mating device and having a second end for mating to a second connector of a second mating device, the coupling device comprising:

a first conductor for extending and retracting at the first end;

a second conductor at the second end; and a switch having a closed circuit condition for connecting said first conductor in signal communication with said second conductor when said first conductor is in a retracted position, and having an open circuit condition when said first conductor is in an extended position, wherein said first conductor is biased to remain in the extended position.

13. The coupling device of claim 12, further comprising a spring for biasing said first conductor into the extended position to form the open circuit condition, and for allowing said first conductor to retract into the retracted position to form the closed circuit condition.

14. The coupling device according to claim 12, wherein said second conductor is also placed in the extended position and the retracted position, depending upon whether said first conductor is in the extended position or the retracted position, respectively.

15. The coupling device according to claim 12, wherein the first and the second mating devices are both non-illuminating devices.

16. The coupling device according to claim 12, wherein the first and the second mating devices are configured to carry media signals.

17. The coupling device according to claim 12, further comprising a housing, and wherein said switch comprises a third conductor, slidably mounted within said housing, for contacting said first conductor to form a conductive path in the closed circuit condition.

18. The coupling device according to claim 17, wherein said third conductor is biased to permanently form an electrical connection with said second conductor.

19. The coupling device according to claim 17, further comprising a threaded portion for threading onto another threaded portion of the first connector so as to push said first conductor towards said third conductor to form said closed circuit condition.

20. The coupling device according to claim 19, wherein the conductive circuit transitions from the open circuit condition to the closed circuit condition only when a pre-specified amount of torque has been applied to thread the threaded portion onto the other threaded portion.

21. The coupling device according to claim 19, wherein a pre-specified amount of torque is required to push said first conductor towards said third conductor to form said closed circuit condition and to ensure a minimum verifiable level of performance from the coupling device with respect to an electrical connection formed between the first end of the coupling device and the first connector.

* * * * *